US008246767B1

(12) United States Patent
Jablonski et al.

(10) Patent No.: US 8,246,767 B1
(45) Date of Patent: Aug. 21, 2012

(54) HEAT TREATED 9 CR-1 MO STEEL MATERIAL FOR HIGH TEMPERATURE APPLICATION

(75) Inventors: Paul D. Jablonski, Salem, OR (US); David Alman, Corvallis, OR (US); Omer Dogan, Corvallis, OR (US); Gordon Holcomb, Albany, OR (US); Christopher Cowen, Albany, OR (US)

(73) Assignee: The United States of America, as represented by the United States Department of Energy, Washington, DC (US)

( * ) Notice: Subject to any disclaimer, the term of this patent is extended or adjusted under 35 U.S.C. 154(b) by 788 days.

(21) Appl. No.: 12/209,488

(22) Filed: Sep. 12, 2008

Related U.S. Application Data

(63) Continuation-in-part of application No. 11/226,283, filed on Sep. 15, 2005, now Pat. No. 7,553,517.

(51) Int. Cl.
*C21D 6/02* (2006.01)

(52) U.S. Cl. ..... 148/607; 148/611; 148/605; 148/622; 148/664; 420/68; 420/71

(58) Field of Classification Search ..... 148/607
See application file for complete search history.

(56) References Cited

U.S. PATENT DOCUMENTS 3,053,706 A * 9/1962 Gregory et al. ..... 75/240
3,953,201 A 4/1976 Wood et al.
4,261,739 A 4/1981 Douthett et al.
4,461,811 A 7/1984 Borneman et al.
4,581,066 A 4/1986 Maruhashi et al.
4,640,722 A 2/1987 Gorman
4,834,808 A 5/1989 Hill
4,964,926 A 10/1990 Hill
5,051,234 A 9/1991 Shinagawa et al.
5,310,431 A 5/1994 Buck et al.
5,843,370 A 12/1998 Koyama et al.
5,851,316 A 12/1998 Yazawa et al.
6,514,359 B2 2/2003 Kawano et al.
2006/0054253 A1 3/2006 Fujitsuna et al.

* cited by examiner

*Primary Examiner* — Roy King
*Assistant Examiner* — Christopher Kessler
(74) *Attorney, Agent, or Firm* — James B. Potts; Mark P. Dvorscak; John T. Lucas

(57) ABSTRACT

The invention relates to a composition and heat treatment for a high-temperature, titanium alloyed, 9 Cr-1 Mo steel exhibiting improved creep strength and oxidation resistance at service temperatures up to 650° C. The novel combination of composition and heat treatment produces a heat treated material containing both large primary titanium carbides and small secondary titanium carbides. The primary titanium carbides contribute to creep strength while the secondary titanium carbides act to maintain a higher level of chromium in the finished steel for increased oxidation resistance, and strengthen the steel by impeding the movement of dislocations through the crystal structure. The heat treated material provides improved performance at comparable cost to commonly used high-temperature steels such as ASTM P91 and ASTM P92, and requires heat treatment consisting solely of austenization, rapid cooling, tempering, and final cooling, avoiding the need for any hot-working in the austenite temperature range.

10 Claims, 2 Drawing Sheets

HEAT TREATED 9 CR-1 MO STEEL MATERIAL FOR HIGH TEMPERATURE APPLICATION

RELATION TO OTHER APPLICATIONS

This patent application is a continuation-in-part of and claims priority to U.S. patent application Ser. No. 11/226,283, filed on Sep. 15, 2005 now U.S. Pat. No. 7,553,517, submitted by Jablonski, et al., which is hereby incorporated by reference in its entirety.

STATEMENT OF GOVERNMENTAL SUPPORT

The United States Government has rights in this invention pursuant to the employer-employee relationship of the Government to the inventors as U.S. Department of Energy employees and site-support contractors at the National Energy Technology Laboratory.

TECHNICAL FIELD

One or more embodiment of this invention relates to a composition and heat treatment for a high-temperature, titanium alloyed, 9 Cr-1 Mo steel exhibiting improved creep strength and oxidation resistance at service temperatures up to 650° C. The novel combination of composition and heat treatment produces a heat treated material containing both large (0.5-3 μm) primary titanium carbides and small (5-50 nm) secondary titanium carbides. The primary titanium carbides contribute to creep strength while the secondary titanium carbides act to maintain a higher level of chromium in the finished steel for increased oxidation resistance, and strengthen the steel by impeding the movement of dislocations through the crystal structure. The heat treated 9 Cr-1 Mo material provides improved performance at comparable cost to commonly used high-temperature steels such as ASTM P91 and ASTM P92, and requires heat treatment consisting solely of austenization, rapid cooling, tempering, and final cooling, avoiding the need for any hot-working in the austenite temperature range

BACKGROUND OF THE INVENTION

One or more embodiments of this invention relates to a heat treated 9 Cr-1 Mo material produced with a 9 Cr-1 Mo alloy of specific composition heat treated in an austenization, rapid cooling, tempering, final cooling cycle, such that the heat treated material exhibits improved resistance to oxidation and high temperature corrosion over currently used high-temperature 9 Cr-1 Mo steels, such as ASTM P91 and ASTM P92, among others. The heat treated 9 Cr-1 Mo material of this invention is suitable for use in situations requiring resistance to high pressures and oxidation resistance at high temperatures, such as steam generators, boilers, chemical industry equipment, and the like.

The constraints placed on power generation in terms of environmental impact and economics have focused attention on the development of high efficiency, low emission systems. Increasing in the thermal efficiency of a power plant is most effectively achieved by increasing the temperature of the steam driving the power-producing turbine. Currently, typical steam power efficiencies are around 42%, with steam temperatures of 600° C. and pressures of 25-30 MPa. Increasing the operating steam temperature to 625-650° C. will enable thermal efficiencies of around 45% to be achieved. However, the increasing operating temperatures and pressures impose increasingly stringent requirements on the materials of construction.

A well-known material capable of satisfying the requirements noted above is austenitic stainless steel. However, austenitic stainless steel is relatively expensive, and its use in commercial plants is limited for economic reasons. In addition, austenitic stainless steel has a large thermal expansion coefficient and can experience relatively large thermal stresses during transient plant operations, start-up, and shutdown. For these reasons, the use of austenitic stainless steel in plants is problematic. More often, 9 Cr-1 Mo steels, such as ASTM P91 and ASTM P92, among others, are used as an effective compromise to balance cost and high-temperature demands.

The 9 Cr-1 Mo steels such as ASTM P91 and ASTM P92, among others, generally provide sufficient strength, resistance to corrosion and oxidation, low thermal expansion, and adequate fatigue resistance. The high chromium (Cr) content in these steels results in an oxide film composed of outer layer iron (Fe) oxides and inner layer Cr oxides or Fe—Cr oxides. Generally, Cr in an amount of not smaller than 8.0% is necessary to form a sound oxide film, while an upper limit of approximately 9.5% is established to allow consistent weldability. Molybdenum (Mo) is used as a solid-solution hardening element and a precipitation-hardening element to form highly dispersed carbides and improve the high temperature creep strength of the steels. Mo is limited to approximately 1% or less, because exposure of the 9 Cr-1 Mo steels with Mo at 600-650° C. has been shown to result in the precipitation of Laves-phase, which removes the element from solid solution and reduces solid-solution strengthening. Additionally, these steels have a typical carbon (C) content of approximately 0.1 wt %, which provides sufficient strength while allowing the material to respond well to hot and cold bending, as well as to welding. The stress rupture strengths of these steels are increased by the addition of carbide formers Niobium (Nb) and Vanadium (V). Tungsten (W) is further added to ASTM P92 to allow operations at slightly higher temperatures than P91, but at increased cost. However, in the currently sought temperature environment of 625-650° C., none of the currently used high-temperature steels such as ASTM P91 and ASTM P92, among others, have a satisfactory level of resistance to oxidation and corrosion, and typically the highest service temperature achievable is limited to 625° C.

The resistance to oxidation and corrosion at higher temperatures can be achieved by increasing the content of Cr to improve oxidation resistance, and adding nickel (Ni) to suppress any resulting δ-ferrite, however a high alloy steel with a high content of Cr and Ni significantly increases cost and becomes comparable to an 18-8 austenitic stainless steel from an economic standpoint. Similarly, cobalt (Co) can be utilized to improve the performance of 9 Cr-1Mo steels at higher temperature, but like W and Ni, the addition of Co can be unattractive economically. It would be advantageous to produce a material similar in composition to commonly used high-temperature steels such as ASTM P91 and ASTM P92 that utilizes a relatively inexpensive alloying addition for increased high-temperature performance.

Titanium (Ti) is an economically attractive alloying element and has been investigated for 9 Cr-1 Mo steels. Typically, Ti has been added as a stabilizer preventing sensitization for applications where high strength requirements limit the degree to which C can be reduced. This practice exploits the stronger tendency of Ti over Cr to form carbides, thus permitting the matrix to retain the corrosion inhibiting Cr. However, it is known that Ti can impart brittleness, and the use of Ti as a stabilizer typically emphasizes a Ti content as low as possible, but at a ratio to C or C plus nitrogen (N) on the order of ten or more. See Grubb, et al, "Micromechanisms of Brittle Fracture in Titanium-stabilized and α-Embrittled Ferritic Stainless Steels," *Toughness of Ferritic Stainless Steels*, American Society of Testing and Materials STP 706 (1980). This combination of requirements tends to necessitate a relatively low carbon level of typically 0.03% or less when Ti stabilization is utilized, which limits application where higher strengths and hardness are required. See U.S. Pat. No. 5,851,316, issued to Yazawa, et al, issued Dec. 22, 1998; U.S. Pat. No. 5,843,370, issued to Koyama, et al, issued Dec. 1, 1998; U.S. Pat. No. 5,051,234, issued to Shinagawa, et al, issued Sep. 24, 1991; U.S. Pat. No. 4,640,722, issued to Gorman, issued Feb. 3, 1987; U.S. Pat. No. 4,461,811, issued to Borneman, et al, issued Jul. 24, 1984; U.S. Pat. No. 4,261,739, issued to Douthett, et al, issued Apr. 14, 1981; U.S. Pat. No. 3,953,201, issued to Wood, et al, issued Apr. 27, 1976. Ti and Nb have also been used in combination for stabilization, but low carbon levels remain a requirement. Additionally, Mo is often treated as an optional or impurity element. See U.S. Pat. No. 4,964,926, issued to Hill, issued Oct. 23, 1990; U.S. Pat. No. 4,834,808, issued to Hill, issued May 30, 1989; U.S. Pat. No. 4,581,066, issued to Maruhashi, et al, issued Apr. 8, 1986.

Ti has also been utilized in 9 Cr-1 Mo steels as a carbide-forming agent which contributes to precipitation strengthening. Precipitation strengthening with Ti requires the dissolution of primary titanium carbides by austenization at high temperature, often greater than 1300° C., in order to dissolve the low-solubility primary titanium carbide as completely as possible. On reheating, fine precipitates of secondary titanium carbide typically less than 30 nm in size distribute throughout the matrix and provide strengthening by acting to impede the movement of dislocations. Dissolution of all or most of the primary titanium carbide during austenization is usually specified, and remaining primary titanium carbides are strictly minimized to avoid degradation of creep properties. Hot working in the austenite temperature range can also be specified to further promote the dissolution of the primary titanium carbides. The latter step, in particular, adds significant processing time and cost to a typical heat treatment that might otherwise consist solely of austenization, cooling, and tempering.

As an example, U.S. Pat. No. 5,310,431, issued to Buck, issued on May 10, 1994, discusses a steel utilizing Ti as an alloying element for precipitation strengthening in a steel similar in composition to commonly used high-temperature 9 Cr-1 Mo steels, such as ASTM P91 or ASTM P92. The '431 steel produces secondary MX precipitates (M=Ti, Nb, Hafnium (Hf), Zirconium (Zr), and Tantalum (Ta), and X=C) to reduce interparticle spacing and produce a microstructure of uniformly dispersed MX precipitates. A stated primary objective during austenization of the '431 steel is dissolution of all or most of the primary MX precipitates, as any remaining primary MX precipitates following austenization are said to reduce the creep properties and toughness of the '431 steel. The '431 steel specifies an alloy which is face-centered cubic (FCC) above 900° C. and extensively discusses stabilizing elements to avoid formation of any body centered cubic (BCC) high temperature δ-ferrite during austenization. Acceptable austenite stabilizers are Co, Copper (Cu), or Zr, with Co as the preferred element. The '431 patent presents examples of a Ti bearing alloy austenized at 1300° C. in order to form secondary TiC precipitates, but in order to avoid the formation of δ-ferrite and maintain the specified FCC structure at this temperature, a steel with base composition of 3.0 wt. % Co and 1.0 wt. % Ni is used. A typically used high-temperature 9 Cr-1 Mo steel such as ASTM P91 or ASTM P92, which minimizes Ni content and avoids Co as an alloying element for economic reasons, would not avoid the formation of δ-ferrite if alloyed with Ti and austenized at 1300° C. Additionally, the '431 steel provokes the precipitation of secondary MX precipitates by cooling the alloy to a temperature above ambient, preferably 900° C., and holding for ½ hour before allowing the alloy to cool to room temperature. This stepped cooling method produces a microstructure of martensitic, bainitic, and ferritic steel.

U.S. patent application Ser. No. 11/250,492, submitted by Fujitsuna, et al, published Mar. 16, 2006, also discusses a steel utilizing Ti as an optional alloying element to form secondary titanium carbides in a steel similar in composition to commonly used high-temperature 9 Cr-1 Mo steels, such as ASTM P91 or ASTM P92. The '492 steel specifies dissolution of primary titanium carbides by extensive predetermined plastic working, such as forging, rolling, extrusion, or the like, at temperatures preferably 1300° C. or higher. Following this hot working, the '492 steel is annealed at a temperature between 1000° C. and 1150° C. for one hour, cooled below its $Ac_1$ transformation temperature, and tempered at a temperature between 650° C. and 800° C. for one hour. This process is designed to produce steel having a martensitic structure with no large or coarse primary titanium carbides. The '492 application does demonstrate a titanium alloyed steel exhibiting slightly increased creep rupture performance over comparison steels similar in composition to ASTM P91 or ASTM P92 after this treatment, however, as earlier stated, the requirement for extensive hot working at temperatures of 1250° C. or greater adds significant processing time and cost. Additionally, the titanium alloyed steel demonstrated by the '492 application also contains tungsten which, like cobalt, is a relatively expensive alloying agent to be avoided if possible.

U.S. Pat. No. 6,514,359, issued to Kawano, issued Feb. 4, 2003, also discusses a steel utilizing Ti as an optional alloying element to form secondary titanium carbides in a steel similar in composition to commonly used high-temperature 9 Cr-1 Mo steels such as ASTM P91 or ASTM P92. The '359 patent considers V containing steels with Nb, Ti, N, Ta, Cu, Ni, and/or Co added to form primary MX precipitates, and calls for dissolution of these primary MX precipitates at an austenization temperature preferably 900-1100° C. The dissolved primary MX precipitates subsequently form precipitation strengthening secondary MX precipitates 30 nm or less at tempering. The '359 patent demonstrates one example steel wherein Nb and Ti are utilized as the precipitation strengthening elements, and indicates that secondary MX precipitations occur following the specified heat treatment with austenization at 950° C. However, given the extraordinarily low solubility of primary titanium carbide in ferrite at 950° C., it is unlikely that primary titanium carbide is a significant contributor to these particular secondary MX precipitates.

The object of one or more embodiments disclosed herein is to provide a heat treated 9Cr-1Mo material produced with a 9 Cr-1 Mo alloy of specific composition that is heat treated in an austenization, rapid cooling, tempering, final cooling cycle, such that titanium carbides exist in the material as both primary and secondary precipitates. This heat treated 9Cr-1 Mo material exhibits improved high-temperature creep strength and improved oxidation and corrosion resistance in a temperature environment of 625-650° C. The heat treated 9Cr-1Mo material is produced through a novel combination of composition and heat treatment whereby relatively large (0.5-3 μm) primary titanium carbides are formed during steel production prior to the heat treatment. During conduct of the heat treatment, 40-60% of the primary titanium carbides are dissolved into Ti and C, which subsequently precipitate as relatively small (5-50 nm) secondary titanium carbide precipitates. Unlike many of the existing Ti alloyed 9 Cr-1 Mo materials, which emphasize hot working requirements intended to minimize primary titanium carbide and maximize secondary titanium carbide, this process produces a heat treated 9Cr-1Mo material which intentionally retains a percentage of the primary titanium carbides for creep strength in conjunction with precipitated secondary titanium carbides distributed throughout the matrix. The secondary titanium carbides maintain a higher level of chromium in the finished steel for increased oxidation resistance, and strengthen the steel by impeding the movement of dislocations through the crystal structure.

The heat treated 9Cr-1Mo material thereby provides substantial performance and economic advantage on several fronts. First, the material uses an additive alloying element, Ti, that is relatively inexpensive as compared to W, Ni, Co, or other alloying element additions, to produce a material comparable in cost to currently used high-temperature 9 Cr-1 Mo steels, such as ASTM P91 and ASTM P92, among others. Second, the heat treated 9Cr-1Mo material requires only an austenization, rapid cooling, tempering, final cooling cycle to realize substantial performance improvements, and avoids costly and time-consuming requirements for hot-working in the austenite temperature range. Third, the improved high-temperature properties significantly reduce the frequency of costly operational shutdowns for necessary replacement of fabricated items. Additional advantages of the heat treated 9Cr-1Mo material not listed here will undoubtedly further accrue due to its improved performance over currently used high-temperature 9 Cr-1 Mo steels available at comparable cost.

SUMMARY OF INVENTION

It is an object of one embodiment to provide a heat treated 9Cr-1Mo material which exhibits improved high-temperature long-term creep strength over the currently used high-temperature 9 Cr-1 Mo steels, such as ASTM P91 and ASTM P92, among others.

It is another object of one embodiment to provide a heat treated 9Cr-1Mo material which exhibits improved high-temperature oxidation and corrosion resistance over the currently used high-temperature 9 Cr-1 Mo steels, such as ASTM P91 and ASTM P92, among others.

It is another object of one embodiment to provide a heat treated 9Cr-1Mo material which exhibits improved high-temperature properties by utilizing an additive alloying element, titanium, that is relatively inexpensive as compared to W, Ni, Co, or other alloying element additions, such that the heat treated 9Cr-1Mo material is comparable in cost to the currently used high-temperature 9 Cr-1 Mo steels such as ASTM P91 and ASTM P92, among others.

It is another object of one embodiment to provide a heat treated 9Cr-1Mo material utilizing primary and secondary TiC for improved high-temperature properties which avoids requirements for forging, rolling, extrusion, or other hot-working in the austenite temperature range, such that processing time and cost remains comparable to currently used high-temperature 9 Cr-1 Mo steels, such as ASTM P91 and ASTM P92, among others.

It is another object of one embodiment to provide a heat treated 9Cr-1Mo material wherein the phase field of the alloy is fully austenitic from about 910° C. to about 1160° C., but above 1160° C. a portion of the austenite reverts to a body-centered cubic phase and does not form martensite or bainite when quenched, such that a two-phase microstructure is produced.

It is a another object of one embodiment to provide a heat treated 9Cr-1Mo material with improved high-temperature properties such that the frequency of operational shutdowns for necessary replacement of fabricated items is significantly reduced over that required for currently used high-temperature 9 Cr-1 Mo steels, such as ASTM P91 and ASTM P92, among others.

Thus, a heat treated 9Cr-1Mo material is disclosed exhibiting improved high-temperature, long-term creep strength and improved oxidation and corrosion resistance, which consists essentially of, by weight %:

C: 0.05-0.15
Si: 0.1-1.0
Mn: 0.2-1.0
Cr: 8.0-13.0
Mo: 0.5-1.5
V: 0.1-0.4
Nb: 0.02-0.2
Ti: 0.05-0.2
N: not more than 0.07
Ni: not more than 0.8
P: not more than 0.03
S: Not more than 0.03
Al: not more than 0.06

And the balance Fe and incidental impurities, wherein after melting, mixing, and fabricating, the 9Cr-1Mo alloy is austenized at a temperature and for a time sufficient to dissolve about 40-60% and preferably about 50% of the primary TiC, rapidly cooled, tempered at a temperature and for a time sufficient to precipitate secondary TiC within the matrix, and subjected to final cooling. Here, and as used hereinafter, the expression "primary TiC" is meant to include MX particles in steel where M=Ti and X=C, where the MX particles are greater than 0.5 μm along the greatest axial dimension of the MX grain and are formed during initial steel solidification or soft annealing prior to austenizing heat treatment. The expression "secondary TiC" is meant to include MX particles in steel where M=Ti and X=C, wherein the MX particles are less than 200 nm along the greatest axial dimension of the MX grain and are formed as precipitates of titanium placed in solution by the dissolution of primary TiC.

The austenization treatment serves to both austenize the material and dissolve about 40-60% and preferably about 50% of the primary TiC to place the titanium and carbon in solution. The remaining undissolved primary TiC is maintained for creep strength. The alloy is fully austenitic from about 960-1160° C., but above 1160° C. a portion of the austenite reverts to the high temperature BCC phase. This BCC phase will not form martensite or bainite when rapidly cooled, resulting in a two-phase microstructure. Subsequent tempering causes the titanium in solution to produce secondary TiC within the matrix of the material. This heat treated 9Cr-1Mo alloy requires no additional hot working such as forging, rolling, extrusion, swaging, or the like in the austenite temperature range, and exhibits improved high-temperature creep strength and improved oxidation and corrosion resistance over currently used high temperature 9 Cr-1 Mo alloys, such as ASTM P91 and ASTM P92, among others.

DETAILED DESCRIPTION OF THE PREFERRED EMBODIMENTS

Figure 1:
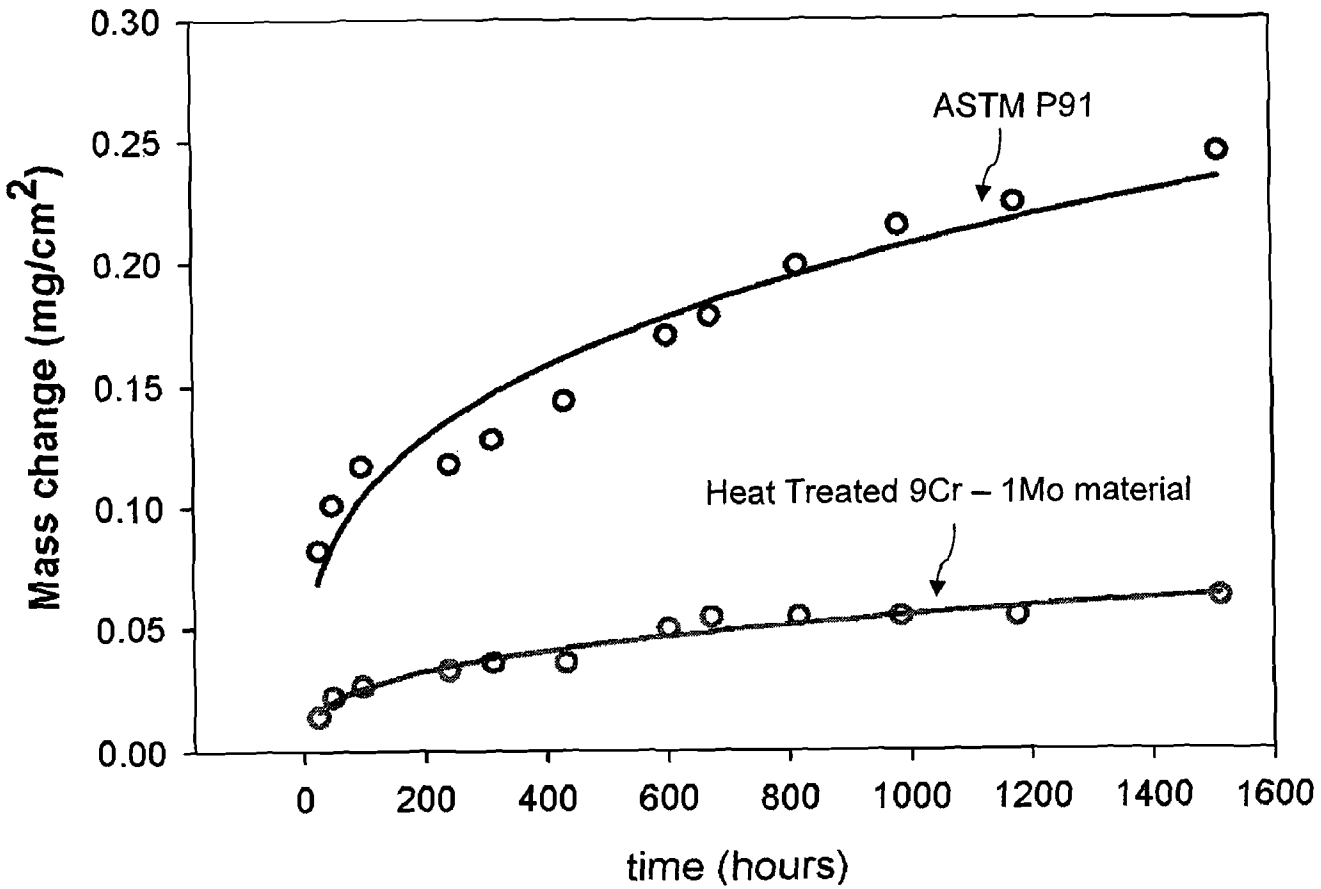
FIG. 1 shows the improved oxidation of the heat treated 9Cr-1Mo alloy at 650° C. over comparison material ASTM P91.

The following description is provided to enable any person skilled in the art to use the invention and sets forth the best mode contemplated by the inventor for carrying out the invention. Various modifications, however, will remain readily apparent to those skilled in the art, since the principles of the present invention are defined herein specifically to provide a heat treated 9Cr-1Mo material having a specific composition that is heat treated in an austenization, rapid cool, temper, final cool cycle, such that titanium carbides are present as both primary and secondary precipitates. The heat treated 9Cr-1Mo alloy exhibits improved high-temperature creep strength and improved oxidation and corrosion resistance in a temperature environment of 625-650° C. while remaining economically comparable to the currently used high-temperature 9 Cr-1 Mo steels ASTM P91 and ASTM P92, among others.

The improved performance of the heat treated 9Cr-1Mo material disclosed herein results from the addition of titanium and a subsequent heat treatment wherein the alloy is austenized at a temperature exceeding that typically used for 9 Cr-1 Mo steels. Generally speaking, titanium added to steel forms coarse and large carbides, nitrides, and carbonitride inclusions in the steel. This reduces the amount of strengthening carbides, nitrides, and carbonitrides which may otherwise form, for example, with V and Nb, and the creep strength of the steel is lowered. The inventors have found, however, that preparing the composition alloy disclosed, then austenizing at a time and temperature sufficient to dissolve approximately 40-60% and preferably about 50% of the primary TiC, followed by rapid cooling and tempering at a time and temperature sufficient to precipitate secondary TiC within the matrix, followed by final cooling, provides a material containing both primary TiC for grain size refinement and increased grain boundary strengthening and cohesion, as well as secondary TiC distributed throughout the matrix for increased creep strength and oxidation resistance. This heat treated 9Cr-1Mo material requires no additional fabrication, such as forging, rolling, extrusion, or swaging, and exhibits improved high-temperature performance over currently used high-temperature 9 Cr-1 Mo alloys such as ASTM P91 and ASTM P92, among others.

Heat Treated 9 Cr-1 Mo Material Composition

The composition of the 9 Cr-1 Mo alloy used in the heat treated 9 Cr-1 Mo material is preferably restricted to a particular one for the following reasons.

Carbon (C):

Carbon combines with Cr, Mo, V, Ti and Nb to form carbide phases, which result in improved high-temperature creep strength and increased microstructural stability under prolonged exposures at elevated temperature. With reduced carbon content, the ferritic structure is stabilized, degrading the strength due to the decreased amount of austenite available to transform to martensite upon quenching. With increased carbon content, the $Ac_1$ point may decrease markedly, reducing applicability for high temperature service. Additionally, an increase in the amount of C may increase the hardness to an undesirable level, degrading formability and weldability. Therefore, the carbon content should be limited within the range 0.05-0.15 wt. %, and preferably 0.08-0.12 wt. %.

Silicon (Si):

Silicon is added as a deoxidizing agent, to improve the castability, and to increase resistance to steam oxidation. With a silicon content under 0.01 wt. %, the desired effect cannot be obtained. However, with a silicon content over 1.0 wt. %, the amount of ferrite in the steel increases, thus leading to lower toughness and impaired creep strength. Therefore, the silicon content should be limited within the range 0.1-1.0 wt. %, and preferably 0.2-0.5 wt %

Manganese (Mn):

Manganese is added to improve hot formability and to facilitate the removal of impurities such as phosphorus and sulfur during melting. With a manganese content under 0.2 wt %, the desired effect cannot be obtained. However, with a manganese content over 1.0%, a hardened phase is formed, impairing toughness. Therefore, the manganese content should be limited within the range 0.2-1.0 wt. %, and preferably 0.2-0.5 wt. %.

Chromium (Cr)

Chromium is added to give the steel a satisfactory level of hot corrosion resistance, and is an essential element in the formation of a stable oxide scale for high-temperature oxidation resistance. With a Chromium content under 8.0 wt. %, the desired effect cannot be obtained. However, with a Chromium content over 13.0 wt. %, the amount of delta-ferrite increases to impair strength and toughness. Therefore, the Chromium content should be limited within the range 8.0-13.0 wt. %, and preferably 8.0-9.5 wt. %.

Molybdenum (Mo):

Molybdenum is added to achieve solution strengthening and improve creep strength. With a molybdenum content under 0.5 wt. %, the desired effect cannot be obtained. However, with a molybdenum content over 1.5 wt. %, during service lifetimes in high temperature environments, precipitation of a Laves phase ($Fe_2Mo$) significantly impacts toughness. Therefore, the molybdenum content should be limited within the range 0.5-1.5 wt. %, and preferably 0.85-1.05 wt. %.

Vanadium (V):

Vanadium combines with carbon and nitrogen to form finely dispersed precipitates such as V(C,N), which are stable at high temperature for an extended period of time. The dispersed V(C, N) is effective for improving long-term creep strength. With a vanadium content under 0.1 wt. %, the desired effect cannot be obtained. However, with a vanadium content over 0.4 wt. %, creep strength is impaired. Therefore, vanadium content should be limited within the range 0.1-0.4 wt. %, and preferably 0.18-0.25 wt. %.

Niobium (Nb):

Niobium, like vanadium, combines with carbon and nitrogen to form fine precipitates such as Nb (C, N) which are effective to improve creep strength. Additionally, niobium-rich precipitates aid to prevent fine crystal grains of austenite from coarsening during the austenizing heat treatment. With a niobium content under 0.02 wt. %, the desired effect cannot be obtained. However, with a niobium content over 0.2 wt. %, the formed Nb (C,N) coarsens and impairs creep strength and toughness. Therefore, niobium content should be limited within the range 0.02-0.2 wt. %, and preferably 0.06-0.10 wt. %.

Titanium (Ti):

Titanium has the function of producing stable carbides that result in higher creep strength, long term microstructural stability, and improved oxidation resistance. The heat treated material provided by this invention utilizes titanium carbides as both primary and secondary precipitates. The primary TiC are relatively large (0.5-3 μm) and are formed during steel production prior to the heat treatment of the invention. The novel heat combination of composition and heat treatment described herein retains about 60-40% and preferably about 50% of the primary TiC for creep strength and grain boundary pinning/strengthening in the finished steel while dissolving the remaining about 40-60% and preferably about 50% to form relatively small (5-50 nm) secondary TiC, such that the heat treated 9Cr-1Mo material contains secondary TiC and primary TiC in a secondary to primary ratio from about 1:1.5 to about 1.5:1, and preferably about 1:1. The secondary TiC assists in maintaining a higher level of chromium in the finished steel for increased oxidation resistance, and strengthens the novel heat treated material by impeding the glide and climb of matrix phase dislocations throughout the microstructure.

With a titanium content under 0.05 wt. %, the desired effect cannot be obtained. However, with a titanium content over 0.2 wt. %, excessively large carbides may result in the matrix. These large carbides are deleterious to mechanical properties as they typically acts as stress concentration risers. Therefore, the titanium content should be limited to within the range 0.05-0.2 wt. %, and preferably 0.05-0.15 wt. %.

Nitrogen (N):

Nitrogen, when present, combines with vanadium and niobium to form carbonitrides, which are effective to improve creep strength. However, with a nitrogen content over 0.07 wt. %, the formability and weldability are degraded. Therefore, nitrogen content should be limited to less than 0.07 wt. %, and preferably 0.05 wt. % or less.

Nickel (Ni):

Nickel, when present, is an austenite stabilizer, and may be added to effectively stabilize a martensitic structure after quenching. However, when the nickel content is over 0.8 wt. %, the creep strength is lowered. Additionally, increases in nickel content have a significant impact on cost. Therefore, the nickel content should be limited to about 0.8 wt. % or less, and preferably 0.4 wt. % or less.

Phosphorus (P) and Sulfur (S):

Phosphorus and Sulfur are unavoidable impurities adversely affecting toughness, formability, and weldability. Phosphorus should be limited to an amount less than 0.03 wt. %, preferably less than 0.02 wt. %. Sulfur should be limited to an amount less than 0.03 wt. %, and preferably less than 0.01 wt. %.

Aluminum (Al):

Aluminum may be added as a deoxidizing agent. However, when the aluminum content is over 0.06 wt. %, the high-temperature creep strength and toughness is deteriorated. Therefore, the aluminum content should be limited to about 0.06 wt. % or less, and preferably 0.04 wt. % or less.

The range of addition amount of each of the constituent elements and the reason for restricting the range are as described above.

Principles of the Method

The novel heat treated 9Cr-1Mo material described herein exploits the propensity of titanium to form stable, high solubility carbides, in order to produce a material wherein titanium carbides are present as both primary TiC and secondary TiC. The simultaneous presence of these titanium carbides within the heat treated 9Cr-1Mo alloy greatly increases the high-temperature creep strength and oxidation resistance over that of economically comparable high-temperature 9 Cr-1 Mo alloys, such as ASTM P91 and ASTM P92, among others. The balance of primary TiC and secondary TiC responsible for this improvement requires careful control of austenization, rapid cooling, and tempering heat treatment steps, and avoids significant additions to material and processing costs.

The 9 Cr-1 Mo alloy composition is prescribed such that primary TiC is incorporated into the microstructure during the course of steel production by melting, casting, and hot fabrication. Titanium has a very strong affinity for carbon, and titanium carbide has high thermal and chemical stability. As a result, primary TiC will precipitate in steels at very low concentrations of titanium even at high temperatures. This primary TiC acts to control grain growth by pinning grain boundaries and increasing grain boundary strength and cohesion. The ability of primary TiC to resist dissolution is essential to resisting austenitic grain growth at high temperatures during initial solidification, subsequent heat treatments, and processes producing heat-affected zones, such as welding. A component that has experienced grain coarsening is liable to have low dimensional precision owing to quench-hardening distortion, reduced impact value and fatigue life, and, particularly in a high-strength component, degraded delayed fracture properties. Within the novel heat treated material described herein, the stable primary TiC particles formed through alloying with titanium are essential to limit abnormal coarsening of specific austenite grains during high-temperature heating.

The novel heat treated 9Cr-1Mo material described herein further exploits secondary TiC. The austenization treatment is specifically conducted in such a manner as to dissolve approximately half of the primary TiC, and place that titanium in solution. This titanium is maintained in solution during and following the rapid cooling. During tempering, the titanium precipitates out from solution forming secondary TiC homogeneously distributed throughout the matrix of the alloy. The strong affinity of titanium for carbon results in preferential formation of this secondary TiC and reduces the formation of chromium carbides, maintaining a higher level of chromium to form a well adhered protective oxide scale for oxidation resistance. Within the novel heat treated 9Cr-1Mo alloy described herein, the secondary TiC are essential for increasing oxidation resistance, strength, and long-term stability of the microstructure for prolonged services at elevated temperatures.

Material Preparation

The 9 Cr-1 Mo alloy composition of the heat treated 9 Cr-1 Mo material of the present invention generally comprises: C, Si, Mn, Cr, Mo, V, Nb, and Ti. The composition may further comprise N, Ni, P, and S. The balance of the 9 Cr-1 Mo alloy composition is Fe and any additional unavoidable impurities.

The percentages of the elements may be varied within the following ranges, in weight %:

C: 0.05-0.15
Si: 0.1-1.0
Mn: 0.2-1.0
Cr: 8.0-13.0
Mo: 0.5-1.5
V: 0.1-0.4
Nb: 0.02-0.2
Ti: 0.05-0.2
N: not more than 0.07
Ni: not more than 0.8
P: not more than 0.03
S: Not more than 0.03
Al: not more than 0.06
Balance: Fe and unavoidable impurities The 9 Cr-1 Mo alloy composition may be initially prepared with precursor elemental charge materials, or commercially available steel in combination with precursor elemental or master alloy charge materials, provided the elemental ranges as outlined above are satisfied. The 9 Cr-1 Mo alloy may be initially produced in any ordinary equipment and process generally employed in the prior art. For example, the 9 Cr-1 Mo alloy may be initially melted in a furnace such as an electric furnace, a converter, a vacuum furnace, or the like. The melt may then be cast into slabs, billets, or ingots in a continuous casting method or a slab-making method, and thereafter shaped into pipe, sheet, bar, rod, or other applicable product forms. The thus produced 9 Cr-1 Mo alloy is then heat treated by austenization, rapid cooling, tempering, and final cooling, such that the final product is a heat treated 9 Cr-1 Mo material containing both primary TiC to limit grain growth, and secondary TiC for increased oxidation resistance and strength, as further described in more detail below.

Heating to Austenization Temperature

Heating the 9 Cr-1 Mo alloy to a specific quench temperature serves two primary purposes: (i) creating an austenite phase thereby enabling subsequent martensitic transformation for a portion of the austenite, and (ii) dissolution of approximately 50% of the primary TiC to place titanium and carbon in solution prior to rapid cooling. Typically, austenization temperatures of approximately 1050° C. are utilized for commonly used 9 Cr-1 Mo steels, such as ASTM P91 and ASTM P92, among others. However, in the heat treated 9 Cr-1 Mo alloy of this invention, because dissolution of about 40-60% and preferably about 50% of the primary TiC is desired, and because TiC has extremely low solubility at 1050° C., a higher temperature is necessary. The necessary temperature for a given composition may be determined through methods known in the art, such as computational simulation using commercially available materials development software. One such suitable computational simulation is THERMO-CALC software. In one embodiment of the heat treated 9 Cr-1 Mo material described herein, an austenization temperature of approximately 1250+/−20° C. maintained for about ten minutes is sufficient to result in dissolution of about 40-60% of the primary TiC. In this manner, about 40-60% of the primary TiC dissolves to produce titanium and carbon in solution, while the remaining, undissolved primary TiC of approximate size 0.5-3 μm remains in the material to enhance creep strength.

The 9 Cr-1 Mo alloy utilized in the heat treated 9 Cr-1 Mo material of the present invention is fully austenitic from about 960° C. to about 1160° C., however above 1160° C. some portion of the austenite will revert to the high temperature BCC phase (δ-ferrite). Subsequently, this portion of the microstructure in the high temperature BCC phase will not form martensite or bainite when rapidly cooled, resulting in a two-phase microstructure.

Rapid Cooling

After the 9 Cr-1 Mo alloy utilized in the heat treated 9 Cr-1 Mo material disclosed herein is austenized at a temperature and time sufficient to dissolve approximately half of the primary TiC, the 9 Cr-1 Mo alloy is rapidly cooled. Rapid cooling serves two primary purposes: (i) it produces the diffusionless displacive shear transformation that converts the austenite to martensite, and (ii) it suppresses the formation of secondary TiC particles, which require both diffusion and time. Under cooling conditions exceeding approximately 2° C./s, the 9 Cr-1 Mo alloy rapidly reaches a temperature where the diffusivity of titanium is largely insufficient for significant precipitation of TiC dispersions. Thus, the rapid cooling effectively suppresses the precipitation of TiC dispersions and prevents the titanium from precipitating out of solution. This rapid removal of thermal energy also prevents the diffusion of carbon, and carbon remains in solution in the body centered tetragonal (BCT) configuration of martensite, as is well known. In one embodiment of the heat treated material of this invention, the 9 Cr-1 Mo alloy is rapidly cooled by water quenching in order to convert austenite to martensite and suppress precipitation of TiC dispersions. This rapid cooling produces a substantially martensitic microstructure of martensite and δ-ferrite.

Tempering

After rapid cooling, the 9 Cr-1 Mo alloy utilized in the heat treated 9 Cr-1 Mo material disclosed herein is tempered at a temperature exceeding the anticipated service temperature of the heat treated material and below the Ac3 temperature. Tempering serves two primary purposes: (i) rearrangement of the martensite microstructure to form ferrite, and (ii) precipitation of secondary TiC. At tempering, the martensitic structure transforms into a more thermodynamically stable structure and the carbon atoms trapped in the martensite diffuse out of the distorted BCT structure, as is well known. Concurrently, in the 9 Cr-1 Mo alloy utilized in the heat treated 9 Cr-1 Mo material disclosed herein, titanium diffuses through the material bonding with free carbon, forming secondary TiC of about size 5-50 nm distributed within the matrix of the material. The strong affinity of titanium for carbon results in preferential formation of the secondary TiC and reduces the formation of chromium carbides, maintaining a higher level of chromium available for oxidation resistance. Additionally, the secondary TiC strengthens the metal by impeding the movement of dislocations through the crystal structure.

Tempering should be conducted at a temperature exceeding the intended service temperature and below the Ac3 temperature. In one embodiment of the heat treated 9 Cr-1 Mo material intended for a 650° C. service temperature, a tempering temperature of about 755+/−50° C. maintained for about thirty minutes is sufficient to rearrange the martensitic microstructure and facilitate the precipitation of secondary TiC.

Final Cooling

Following tempering, the 9 Cr-1 Mo alloy undergoes final cooling. In one embodiment of the heat treated 9 Cr-1 Mo alloy, the 9 Cr-1 Mo alloy is allowed to air cool. The heat treated 9 Cr-1 Mo material is thus a martensitic steel for high temperature application containing primary TiC for grain size refinement and increased grain boundary strengthening, as well as finely precipitated secondary TiC distributed throughout the matrix of the material for increased creep strength, tensile strength, and corrosion resistance. The tempering temperature exceeds the service temperature of the heat treated material and therefore renders the heat treated 9 Cr-1 Mo material stable in service conditions. This heat treated 9 Cr-1 Mo material requires no additional hot working in the austenite range such as forging, rolling, extrusion, or the like, and exhibits improved high-temperature creep strength and improved oxidation and corrosion resistance over currently used high-temperature 9 Cr-1 Mo steels, such as ASTM P91 and ASTM P92, among others. The heat treated 9 Cr-1 Mo material uses titanium as a major alloying element and avoids the use of comparatively more expensive alloying elements such as nickel, cobalt, or tungsten.

Comparison

A 9 Cr-1 Mo alloy utilized in the heat treated 9 Cr-1 Mo material of the present invention was prepared with the nominal composition (in wt. %) indicated in Table I. For comparison, Table I also includes the nominal compositions of commercial ASTM P91 and ASTM P92. In order to determine a heat treatment sufficient to cause dissolution of about 40-60% and preferably about 50% of the primary TiC, an austenization temperature of 1250° C. was determined using. THERMO-CALC Software for the 9 Cr-1 Mo alloy having Table I composition. This temperature held for about 10 minutes was predicted to cause about 50% dissolution of the primary TiC, so that following tempering, the 9 Cr-1 Mo alloy would contain secondary and primary TiC in a ratio of about 1:1.

TABLE I

Compositions: 9 Cr-1 Mo alloy and comparison materials

| | C | Cr | Mn | Mo | W | V | Si | Nb | Ti | Balance |
|---|---|---|---|---|---|---|---|---|---|---|
| 9 Cr-1 Mo alloy | 0.1 | 8.75 | 0.45 | 0.95 | — | 0.22 | 0.35 | 0.08 | 0.1 | Fe, impurities |
| ASTM P91 | 0.1 | 8.75 | 0.45 | 0.95 | — | 0.22 | 0.35 | 0.08 | — | Fe, impurities |
| ASTM P92 | 0.1 | 8.75 | 0.45 | 0.95 | 1.75 | 0.22 | 0.35 | 0.08 | — | Fe, impurities |

The 9 Cr-1 Mo alloy utilized in the heat treated 9 Cr-1 Mo material of the present invention was produced by vacuum induction melting of elemental charge materials. The molten 9 Cr-1 Mo alloy was poured and solidified in a cylindrical graphite mold 76 mm in diameter. After removing the hot tops and surface layer, the ingots were hot forged and rolled into 12 mm thick plate. The heat treated 9 Cr-1 Mo material was produced by subjecting the plates to austenization at 1250° C. for 10 minutes, water quenching, tempering at 755° C. for thirty minutes, and air cooling. Oxidation specimens were cut in 25 mm×12 mm×3 mm dimensions. They were wet-ground to a 600 grit surface finish with SiC abrasive paper.

The thus produced heat treated 9 Cr-1 Mo material was subjected to oxidation testing conducted in a tube furnace using air bubbled through two columns of distilled water to produce 3% moist air. The testing lasted up to 1500 hours at 650° C. Commercial, as-received ASTM P91 was similarly tested. The oxidation scales were examined using various analytical techniques including scanning electron microscopy, and wavelength-dispersive and energy-dispersive spectroscopy.

The mass gain of the heat treated 9 Cr-1 Mo material compared to ASTM P91 is presented as a function of time in FIG. 1. As expected, each alloy showed a parabolic oxidation rate, and the mass gain of both specimens was due primarily to growth of oxidation scale on the surface. However, in a highly unexpected result, over the full test the total mass gain of the heat treated 9 Cr-1 Mo material disclosed herein was about 5 times lower than ASTM P91. Comparing the Table 1 compositions of the heat treated 9 Cr-1 Mo material disclosed and ASTM P91, it is clear from these highly surprising results that the titanium in the 9 Cr-1 Mo alloy and the subsequent heat treatment specified improved the oxidation resistance substantially.

Tensile testing of the heat treated 9 Cr-1 Mo material was performed at temperatures of 550° C., 600° C., and 650° C. using a screw driven machine at a 0.5 mm/min loading rate. Tensile results are shown in Table II. For comparison, Table II also includes published results for the average yield strength of commercial ASTM P91 steel at the tested temperatures. Again in an unexpected result, the yield strength of the heat treated 9 Cr-1 Mo material was observed to be significantly higher than commercial ASTM P91 steel, demonstrating highly surprising improvements of approximately 27% at 550° C., 65% at 600° C., and 73% at 650° C.

TABLE II

Tensile test results: Heat treated 9Cr—1Mo material and comparison materials

| Temperature (C.) | Yield Strength (MPa) 9Cr—1Mo alloy | Yield Strength (MPa) Std P91 (ave) |
|---|---|---|
| 550 | 406 | 320 |
| 600 | 429 | 260 |
| 650 | 346 | 200 |

Figure 2:
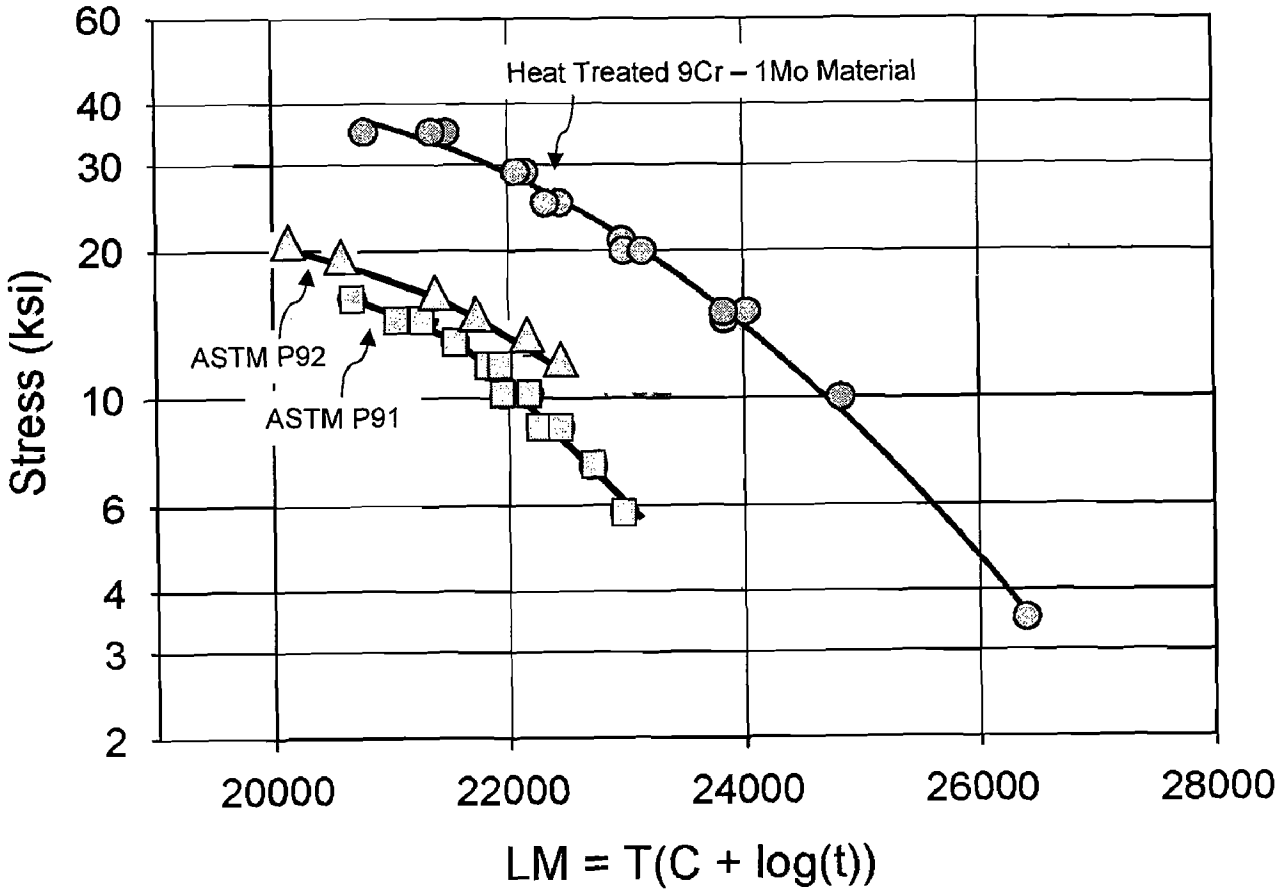
FIG. 2 shows the Larson-Miller Parameter for the heat treated 9Cr-1Mo alloy and comparison materials ASTM P91 and ASTM P92, demonstrating improved creep performance of the heat treated material over ASTM P91 and ASTM P92.

FIG. 2 compares the Larson-Miller (L-M) parameter of the heat treated 9 Cr-1 Mo material with published values for commercial ASTM P91 and commercial ASTM P92. The Larson-Miller parameter is an empirical number reflecting the operating temperature and the creep strength of the alloy, defined in FIG. 2 as L–M=T*(log(t)+22.4), where T is the test temperature in degrees Kelvin and t is the time in hours for rupture to occur at the test temperature. FIG. 2 indicates that the heat treated 9 Cr-1 Mo material exhibits superior time-to-rupture over the currently used high-temperature 9Cr-1Mo steels ASTM P91 and ASTM P92 at all temperature and time conditions examined.

As explained in the foregoing discussion, a heat treated 9 Cr-1 Mo material is provided that is produced by a 9 Cr-1 Mo alloy of specific composition subjected to an austenization, rapid cool, temper, and final cool cycle, such that titanium carbides exist in the heat treated material as both primary and secondary precipitates in a ratio from about a 2:3 to about 3:2. This heat treated 9 Cr-1 Mo material exhibits improved high-temperature creep strength and improved oxidation and corrosion resistance in a temperature environment of 625-650° C. This heat treated 9 Cr-1 Mo material avoids the use of W, Ni, Co, or other expensive alloying elements, and relies on titanium addition to remain economically comparable to currently used high temperature 9 Cr-1 Mo steels, such as ASTM P91 and ASTM P92, among others. The method of heat treatment avoids any hot working requirements in the austenite range and requires only austenizing at a time and temperature sufficient to dissolve approximately 40-60% and preferably about 50% of the primary TiC, rapidly cooling, tempering at a time and temperature sufficient to precipitate secondary TiC within the matrix, and final cooling.

Having described the basic concept of the invention, it will be apparent to those skilled in the art that the foregoing detailed disclosure is intended to be presented by way of example only, and is not limiting. Various alterations, improvements, and modifications are intended to be suggested and are within the scope and spirit of the present invention. Additionally, the recited order of elements or sequences, or the use of numbers, letters, or other designations therefore, is not intended to limit the claimed processes to any order except as may be specified in the claims. Accordingly, the invention is limited only by the following claims and equivalents thereto.

All publications and patent documents cited in this application are incorporated by reference in their entirety for purposes to the same extent as if each individual publication or patent document were so individually denoted.

What is claimed is:

1. A method of producing a heat treated 9 Cr-1 Mo material, comprising the following steps in the order named:

austenizing a 9 Cr-1 Mo alloy comprising 0.05-0.15 wt. % carbon, 8.0-13.0 wt. % chromium, 0.5-1.5 wt. % molybdenum, 0.1-1.0 wt. % silicon, 0.2-1.0 wt. % manganese, 0.1-0.4 wt. % vanadium, 0.02-0.2 wt. % niobium, 0.05-0.2 wt. % titanium, balance Fe and unavoidable impurities, wherein the 9 Cr-1 Mo alloy contains primary TiC 0.5-3.0 μm in diameter, at a temperature wherein the solubility of the primary TiC is sufficient to dissolve about 40-60% of the primary TiC, placing titanium and carbon in solution;

cooling the 9 Cr-1 Mo alloy using an initial cooling step to generate a martensitic microstructure wherein titanium and carbon remain in solution;

tempering the 9 Cr-1 Mo alloy such that titanium and carbon in solution diffuse to precipitate secondary TiC, such that a mass ratio of secondary to primary TiC is from about 1:1.5 to about 1.5:1 in the tempered 9 Cr-1 Mo alloy, where the mass ratio of secondary to primary TiC is the mass of the primary TiC divided by the mass of the secondary TiC; and, cooling the 9 Cr-1 Mo alloy in a final cooling treatment.

2. The method of claim 1, wherein austenizing is conducted at a temperature of 1250+/−20° C. for a period of about ten minutes.

3. The method of claim 1, wherein tempering is conducted at a temperature of 755+/−50° C. for a period of about thirty minutes.

4. The method of claim 1, wherein austenizing is followed by cooling the 9 Cr-1 Mo alloy using an initial cooling step prior to any hot working of the 9 Cr-1 Mo alloy, and tempering is followed by cooling the 9 Cr-1 Mo alloy in a final cooling treatment prior to any hot working of the 9 Cr-1 Mo alloy.

5. The method of claim 1, wherein the initial cooling step provides a cooling rate of at least 2° C./second.

6. The method of claim 1, wherein the mass ratio of secondary to primary TiC is about 1:1.

7. The method of claim 1, wherein the composition of the heat treated 9 Cr-1 Mo material is further limited to 0.08-0.12 wt. % carbon, 8.0-9.5 wt. % chromium, 0.85-1.05 wt. % molybdenum, 0.2-0.5 wt. % silicon, 0.2-1.0 wt. % manganese, 0.18-0.25 wt. % vanadium, 0.06-0.1 wt. % niobium, 0.05-0.15 wt. % titanium, balance Fe and unavoidable impurities.

8. The method of claim 7, wherein austenizing is conducted at a temperature of 1250+/−20° C. for a period of about ten minutes, the initial cooling step provides a cooling rate of at least 2° C./second, and tempering is conducted at a temperature of 755+/−50° C. for a period of about thirty minutes.

9. A method of producing a heat treated 9 Cr-1 Mo material, consisting of the following steps in the order named:

austenizing a 9 Cr-1 Mo alloy comprising 0.05-0.15 wt. % carbon, 8.0-13.0 wt. % chromium, 0.5-1.5 wt. % molybdenum, 0.1-1.0 wt. % silicon, 0.2-1.0 wt. % manganese, 0.1-0.4 wt. % vanadium, 0.02-0.2 wt. % niobium, 0.05-0.2 wt. % titanium, balance Fe and unavoidable impurities, wherein the 9 Cr-1 Mo alloy contains primary TiC 0.5-3.0 μm in diameter, at a temperature wherein the solubility of the primary TiC is sufficient to dissolve about 40-60% of the primary TiC and place titanium and carbon in solution;

cooling the 9 Cr-1 Mo alloy using an initial cooling step to generate a martensitic microstructure wherein the titanium and carbon remain in solution;

tempering the 9 Cr-1 Mo alloy such that the titanium and carbon in solution diffuse to precipitate secondary TiC, such that a mass ratio of secondary to primary TiC is from about 1:1.5 to about 1.5:1 in the tempered 9 Cr-1 Mo alloy, where the mass ratio of secondary to primary TiC is the mass of the primary TiC divided by the mass of the secondary TiC; and, cooling the 9 Cr-1 Mo alloy in a final cooling treatment.

10. The method of claim 9, wherein austenizing is conducted at a temperature of 1250+/−20° C. for a period of about ten minutes, the initial cooling step is water or oil quench, tempering is conducted at a temperature of 755+/−50° C. for a period of about thirty minutes, and the final cooling treatment is air cooling.

* * * * *